US007401936B1

(12) United States Patent
Fan

(10) Patent No.: US 7,401,936 B1
(45) Date of Patent: Jul. 22, 2008

(54) LIGHT ASSEMBLY ADAPTED TO AN UMBRELLA SHANK

(75) Inventor: Ben Fan, He Shan (CN)

(73) Assignee: He Shan Lide Electronic Enterprise Company Ltd., Guangdong (CN)

( * ) Notice: Subject to any disclaimer, the term of this patent is extended or adjusted under 35 U.S.C. 154(b) by 0 days.

(21) Appl. No.: 11/840,480

(22) Filed: Aug. 17, 2007

(51) Int. Cl.
*F21V 33/00* (2006.01)

(52) U.S. Cl. ..... 362/102; 362/191

(58) Field of Classification Search ..... 362/102, 362/119, 120, 253, 196, 190, 191, 109
See application file for complete search history.

(56) References Cited

U.S. PATENT DOCUMENTS 4,174,532 A * 11/1979 Kelley ..... 362/102
6,323,431 B1 * 11/2001 Lin ..... 174/135
D542,454 S * 5/2007 Chan ..... D26/60
2004/0226598 A1 * 11/2004 Li ..... 135/910
2007/0133191 A1 * 6/2007 Ma ..... 362/102

* cited by examiner

*Primary Examiner*—Laura Tso
(74) *Attorney, Agent, or Firm*—Rabin & Berdo, P.C.

(57) ABSTRACT

A light assembly includes a circular base light emitting diodes mounted on the circuit board and electrically connected to a controlling chip, a circular rim mounted on a peripheral edge of the circular base, a transparent cover provided to securely engage with the circular rim to enclose the light emitting diodes and a clamping mechanism securely mounted on two opposed sides of the U shaped passage and having two rubber cushions oppositely movable relative to each other so that when an umbrella shank is extended into the U shaped passage and located between the two rubber cushions, the umbrella shank is securely sandwiched and the light emitting diodes are able to provide illumination.

14 Claims, 12 Drawing Sheets

LIGHT ASSEMBLY ADAPTED TO AN UMBRELLA SHANK

BACKGROUND OF THE INVENTION

1. Field of the Invention

The present invention relates to a light assembly, and more particularly to a light assembly adapted to an umbrella shank.

2. Description of the Prior Art

When carrying an umbrella in the daytime for blocking the sun or in rainy days for the rains, the user's sight is partially blocked by the canopy of the umbrella. Especially, in a raining night, a user with an umbrella crossing the street is a great challenge to the driver's sight of a passing vehicle.

In order to provide sufficient lighting for the umbrella user, a conventional light assembly is introduced to the umbrella. The conventional light assembly includes two semi-circular disks interrelated to each other via a hinge. In addition, a gear assembly is employed to secure engagement of the two semi-circular disks. That is, whenever the conventional light assembly is used, the user will have to drive the gear assembly to bring the two semi-circular disks close to each other. Then the light assembly is ready for application. Over a period of time, due to repetitive application of the light assembly, the effect of the gear assembly is not as good as originally designed. Further, in order to provide sufficient illumination, each semi-circular disk is provided with illuminators. And to provide electricity to each of the semi-circular disks, different cables are required to provide electricity to the illuminators, which increases the manufacture cost of the conventional light assembly.

To overcome the shortcomings, the present invention tends to provide an improved light assembly to mitigate the aforementioned problems.

SUMMARY OF THE INVENTION

The primary objective of the present invention is to provide an improved light assembly in combination with an umbrella shank such that the light assembly is able to securely engage with the umbrella shank to provide illumination when required.

In order to accomplish the foregoing objective, the light assembly of the present invention includes a circular rim and a circular base with the circular rim mounted on a peripheral edge of the circular base. The base has a circuit board mounted thereon and having multiple Light emitting diodes (LEDs) and a U shaped passage. A clamping mechanism is securely received in the U shaped passage and includes two clamping plates oppositely located inside the U shaped passage such that when the umbrella shank is extended through a gap between the two clamping plates, the two clamping plates are able to securely position the umbrella shank.

Other objects, advantages and novel features of the invention will become more apparent from the following detailed description when taken in conjunction with the accompanying drawings.

DETAILED DESCRIPTION OF THE PREFERRED EMBODIMENT

Figure 1:
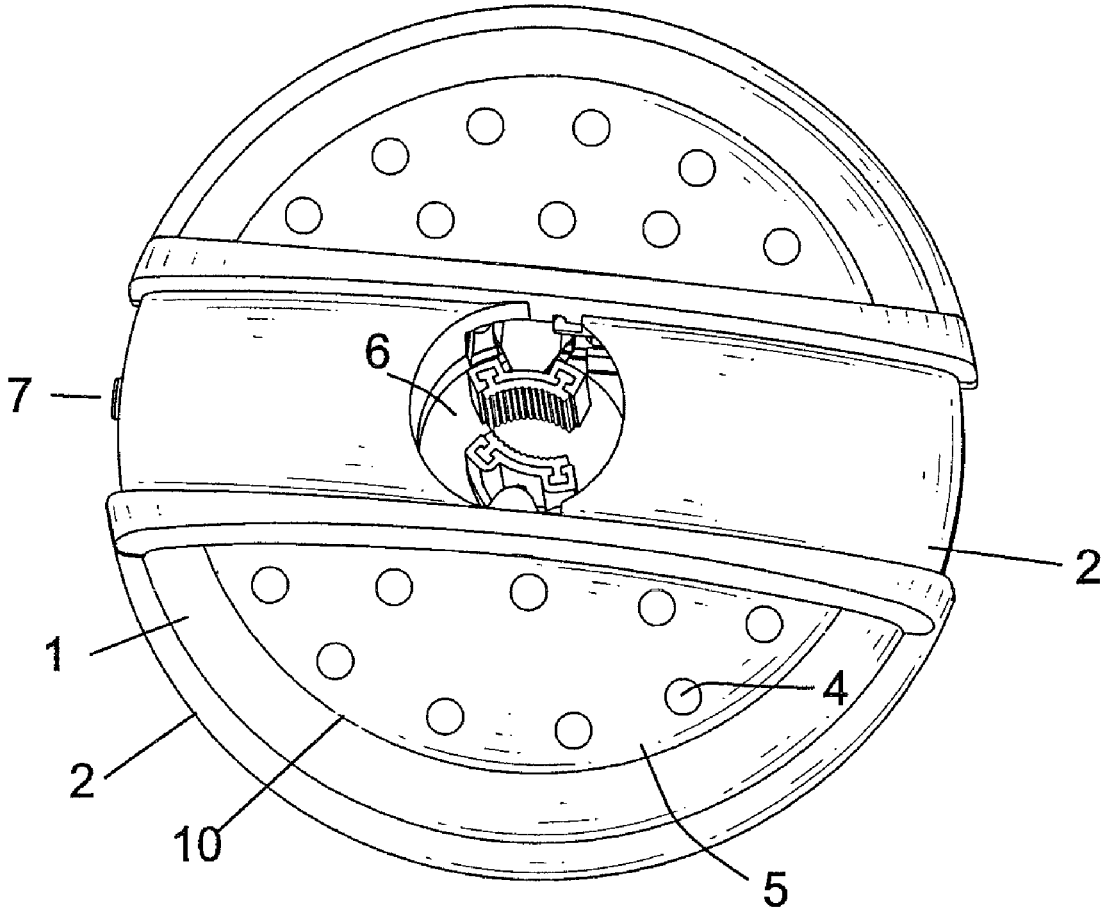
FIG. 1 is a perspective view of the light assembly of the present invention.
Figure 2:
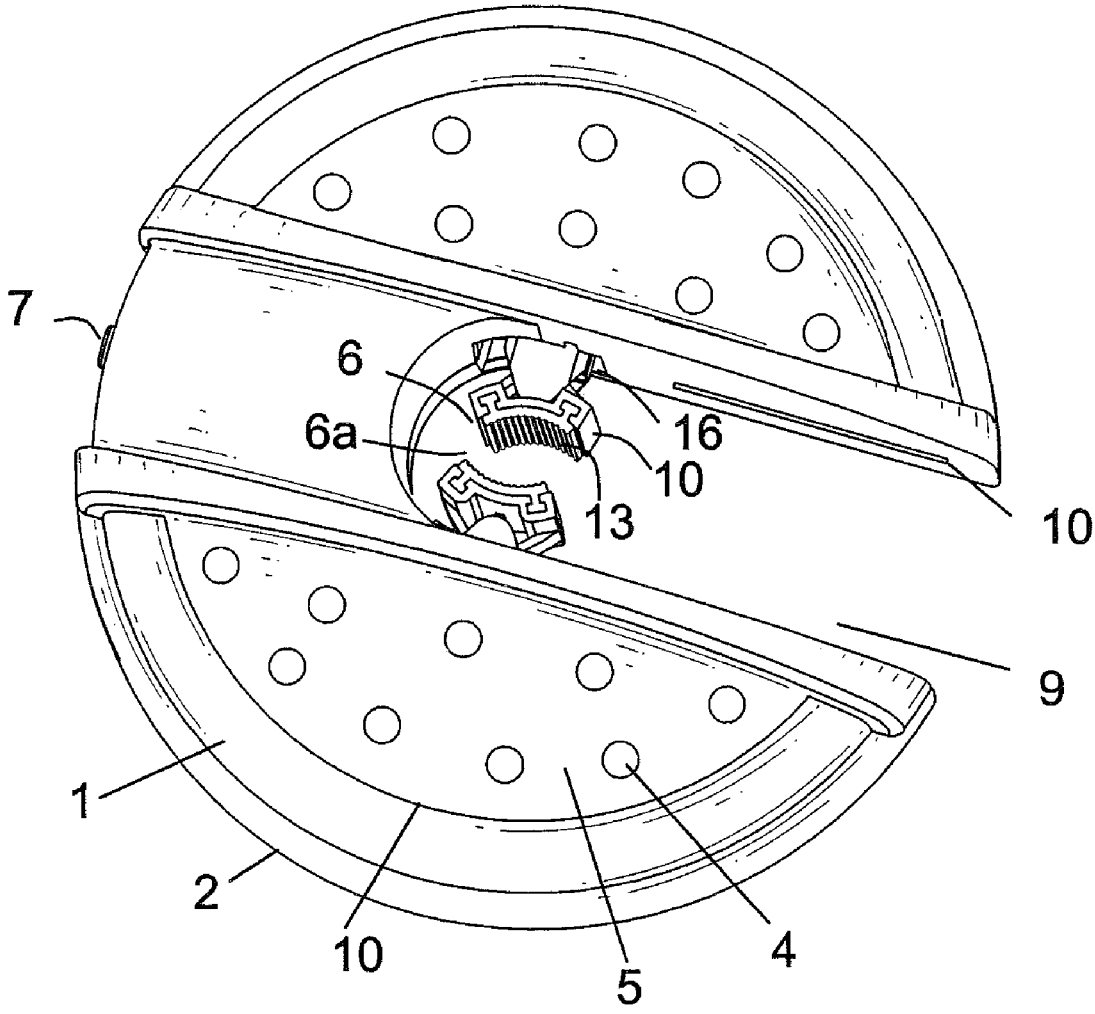
FIG. 2 is a perspective view of the light assembly of the present invention with a cap closing the U shaped passage removed.
Figure 3:
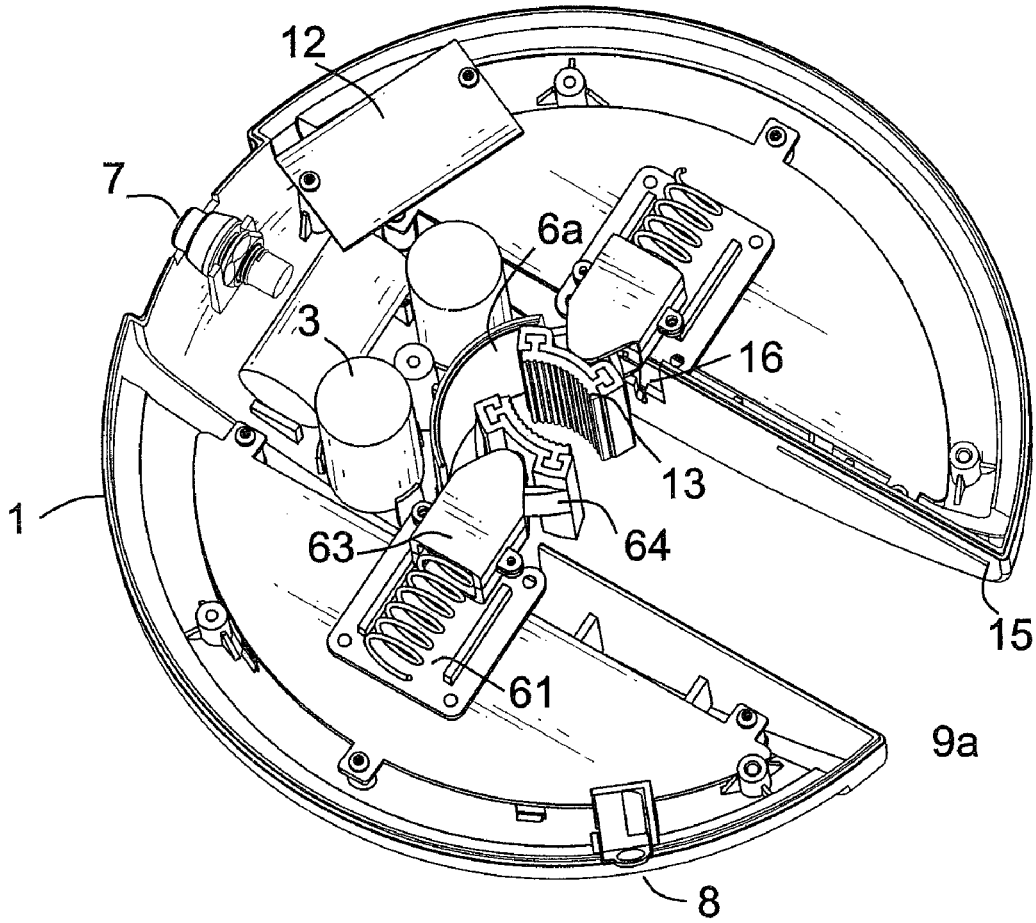
FIG. 3 is a perspective view of the light assembly of the present invention with a transparent cover removed.
Figure 4:
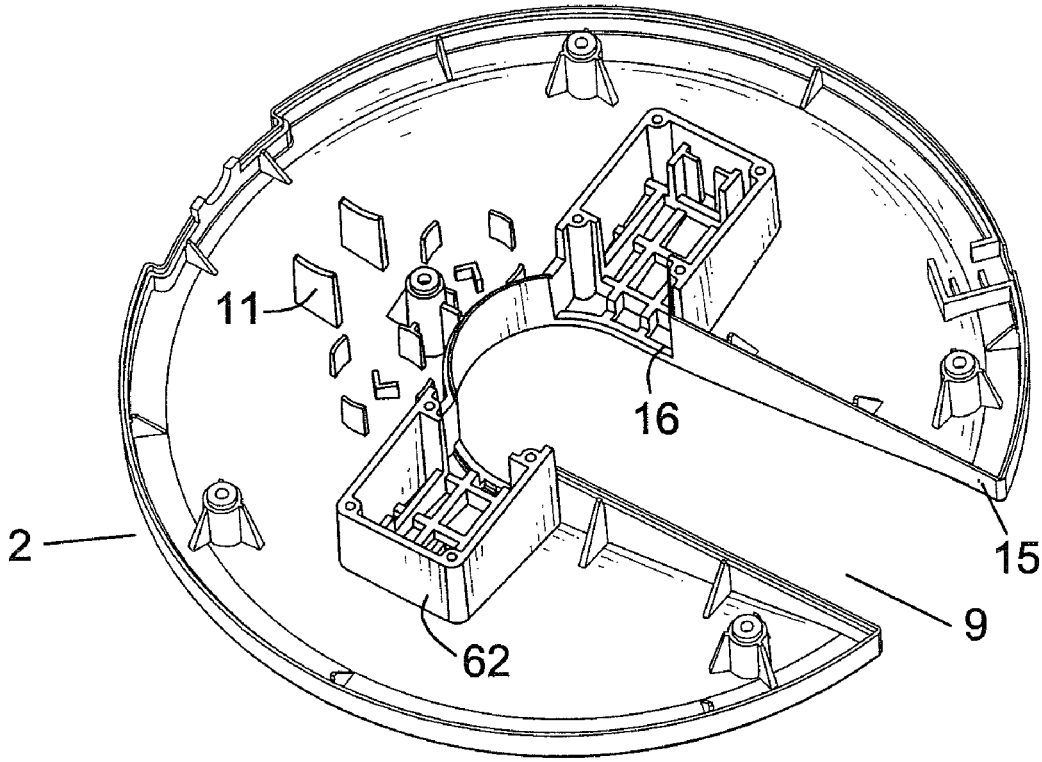
FIG. 4 is a perspective view of the base of the present invention.

With reference to FIG. 1, it is noted that the light assembly in accordance with the present invention includes a circular base (2), a circular rim (1) mounted on a peripheral edge of the circular base (2) and a transparent cover (10) mounted on top of the circular base (2) and securely connected to the circular rim (1). A clamping mechanism (6) is mounted on two opposed sides of the circular base (2). A power switch (7) is provided on a side face of the circular rim (1) and multiple light emitting diodes (4) are mounted on a circuit board (5) which is on top of the circular base (2) and are enclosed by the transparent cover (10) and electrically connected to the power switch (7).

With reference to FIGS. 2, 3, 4, 5 and 10, it is noted that a wedge shaped cap (14) is provided to close a U shaped passage (9) defined in a side of the circular base (2). The U shaped passage (9) communicates with ambient air. The cap (14) has two ribs (17) formed on two opposed side faces thereof and two ears (18) respectively extending from a distal free side of the two opposed side faces of the cap (14).

Figure 9:
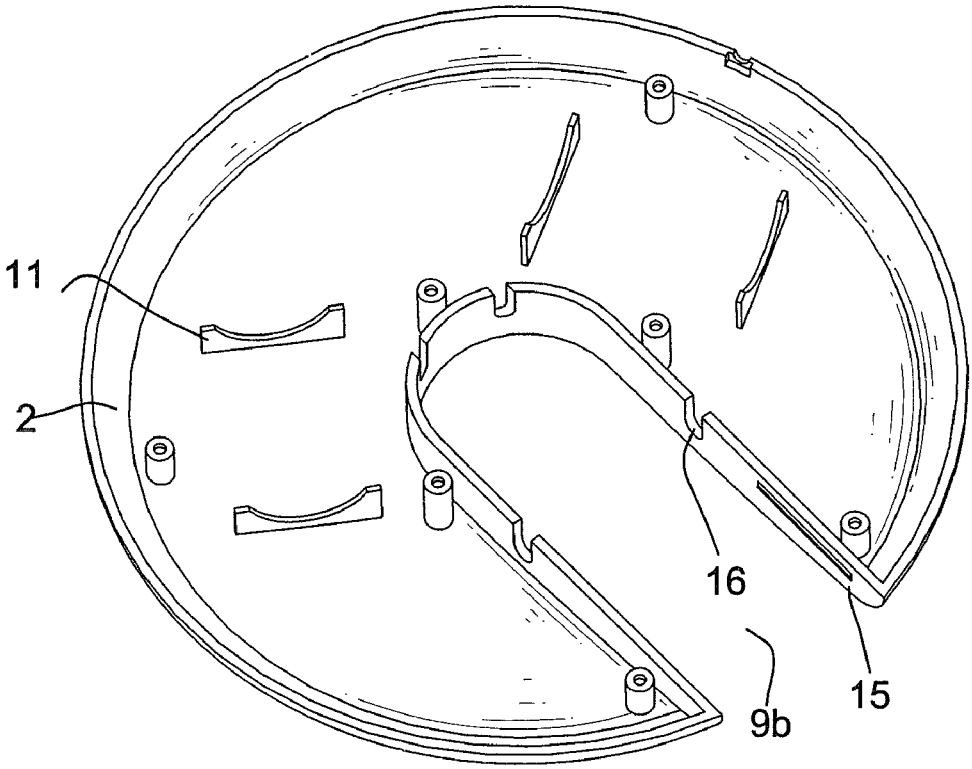
FIG. 9 is a perspective view of the base of the second embodiment.
Figure 10:
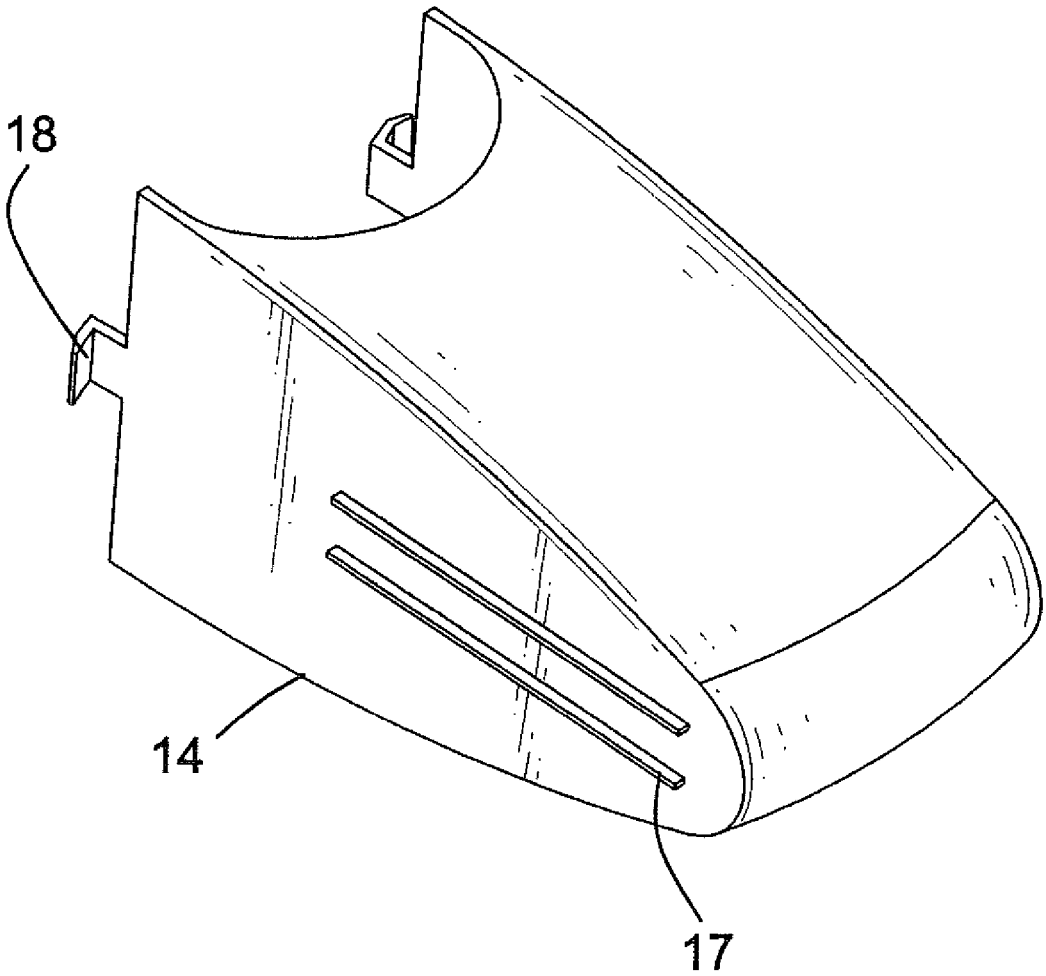
FIG. 10 is a perspective view of the cap closing the U shaped passage.

On top of the circular base (2), after removal of the transparent cover (10), it is noted that a battery (3) is mounted on a battery seat (11) (as shown in FIG. 9) on top of the circular base (2) to provide electricity to the LEDs (4) and electrically connected to the LEDs (4). The battery (3) is electrically connected to a power socket (8) mounted on a side face of the circular base (2) so that when the voltage of the battery (3) is low, the power socket (8) is able to provide electricity to the battery (3) via a cable (not shown). A controlling chip (12) is provided to electrically connect to the circular board (5) to control illumination of the LEDs (4).

The clamping mechanism (6) is provided on two opposed sides of the U shaped passage (9) and having a spring seat (61) mounted on top of the circular base (2) to receive therein a spring (61), a sliding block (63) movably received in the spring seat (62) and abutted by a distal end of the spring (61), an engagement element (65) received in the sliding block (63) and having a finger (651) extending out of the sliding block (63), a pivoting block (63) movably connected to the engagement element (65) and a rubber cushion (13) securely engaged with a side face of the pivoting block (64).

The spring (61) is compressibly received in the spring seat (62) which has an opening in communication with the U shaped passage (9). That is one end of the spring (61) is abutted a side face of the spring seat (62). The sliding block (63) is composed of two halves each having a column (631) formed on a front end thereof, a baffle (632) extending upward from a bottom face thereof and having a indent (633) defined in a free side of the baffle (632). The pivoting block (64) is provided with a passage (640) defined in a side face of the pivoting block (64) to receive therein the two columns (631) of the sliding block (63) and an elongated slot having a first position (641) and a second position (642) in communication with the first position (641). The engagement block (65) further has a flange (650) oppositely formed relative to the finger (651). The rubber cushion (13) is securely connected to a side face of the pivoting block (64) opposite to that of the passage (640).

Figure 5:
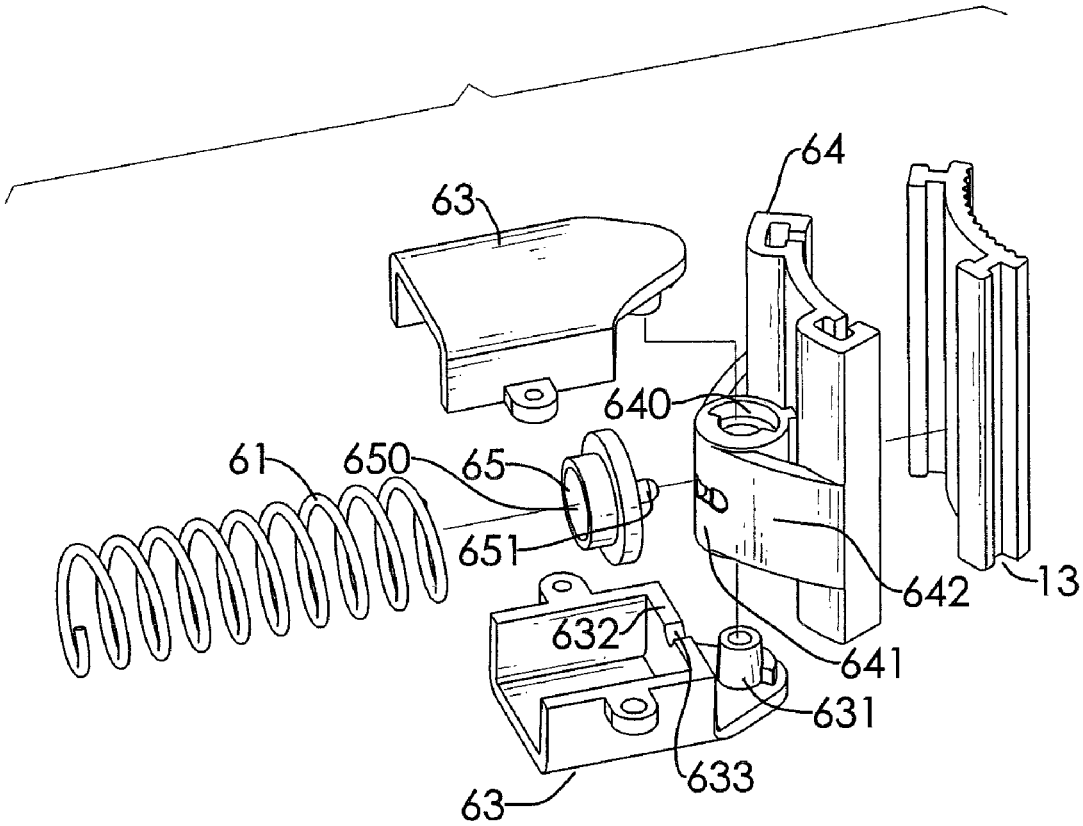
FIG. 5 is an exploded perspective view of the clamping mechanism of the present invention.
Figure 5A:
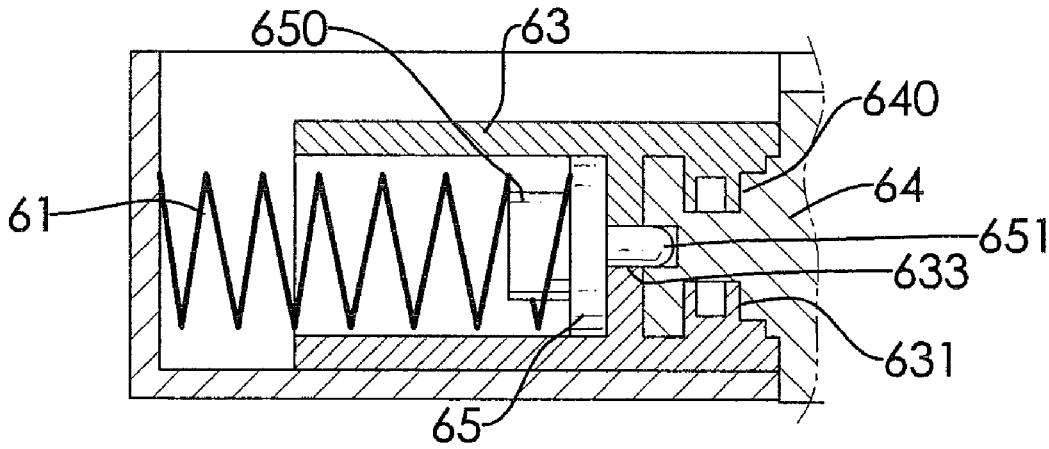
FIG. 5A is a schematically cross sectional view showing that the engagement block is sandwiched between the two halves of the sliding block and the finger of the engagement block is extending into the pivoting block.
Figure 5B:
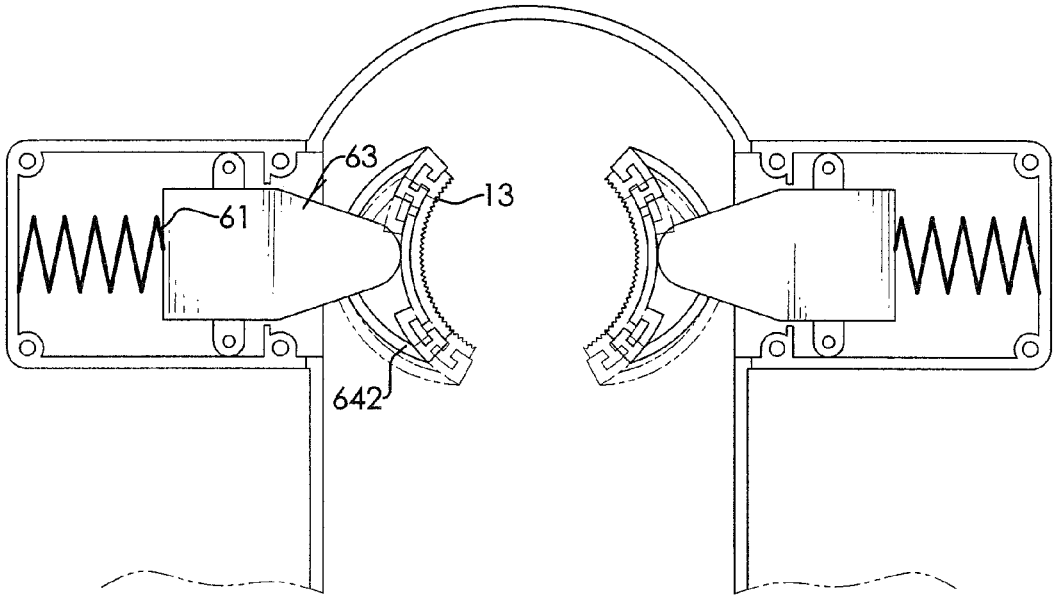
FIG. 5B is a schematically top plan view showing the movement of the pivoting blocks.
Figure 6:
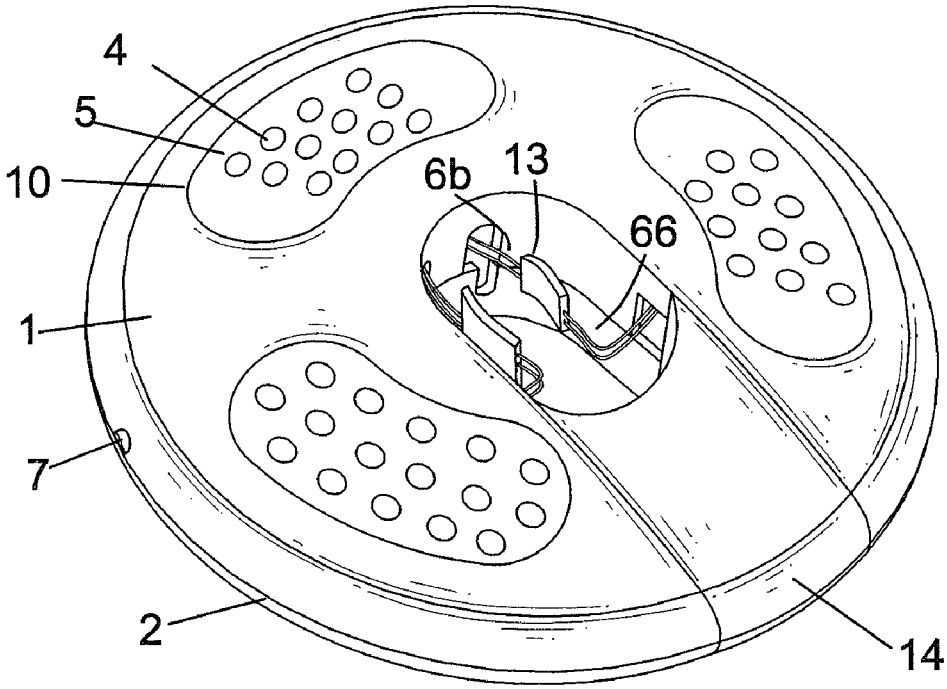
FIG. 6 is a perspective view of the second embodiment of the present invention.
Figure 7:
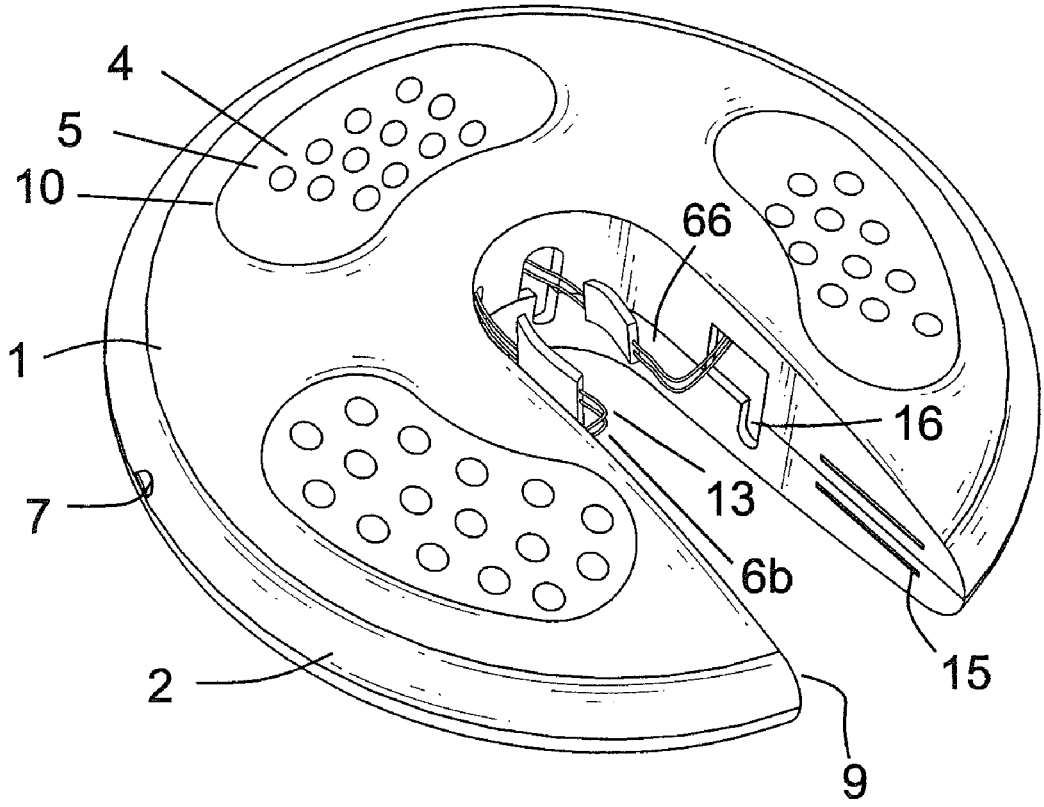
FIG. 7 is a perspective view of the second embodiment with the cap closing the U shaped passage removed.
Figure 8:
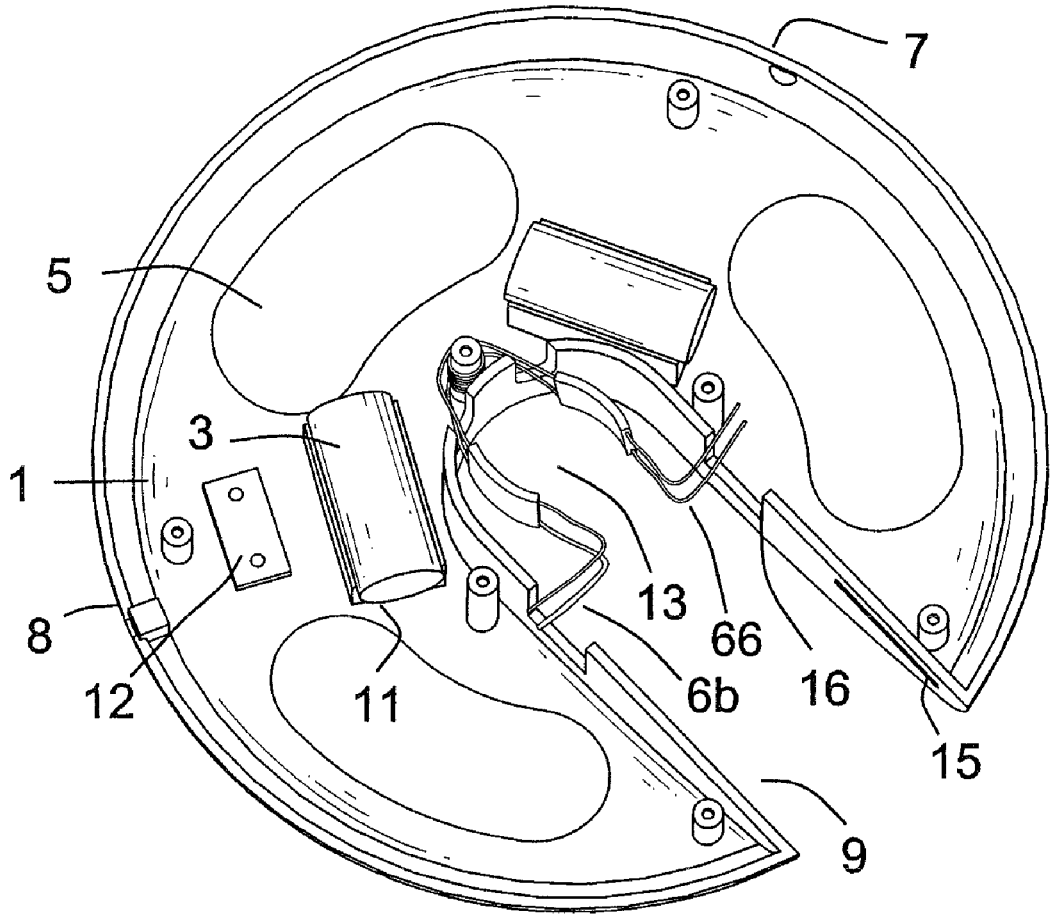
FIG. 8 is a perspective view of the second embodiment with the transparent cover removed.

With reference to FIGS. 5A and 5B, it is noted that after assembly of the clamping mechanism (6) is finished, the column (631) of each of the two halves of the sliding block (63) is inserted into the passage (640) of the pivoting block (64) from different directions. While the two columns (631) are inserted into the passage (640), the engagement block (65) is sandwiched between the two halves of the sliding block (63) with the finger (651) extending out of a hole (not numbered) defined by the combination of the two combined indents (633) and into the elongated slot of the pivoting block (64). The other end of the spring (61) is abutted the flange (650) of the engagement block (65). Because the pivoting block (64) is in engagement with the engagement block (65) and the engagement block (65) is connected to the spring (61), movement of the pivoting block (64) drives the sliding block (63) to move and compresses the spring (61).

Therefore, before the umbrella shank is inserted into the U shaped passage (9), the two fingers (651) from two opposed sides of the U shaped passage (9) are located at the first positions (641) respectively. However, after the umbrella shank is inserted into the U shaped passage (9), the two fingers (651) are moved from the respective two first positions (641) to the respective second positions (642). Thereafter, the rubber cushion (13) from opposite clamping mechanism (6) is able to securely engage with an outer periphery of the umbrella shank to maintain the light assembly on the umbrella shank. After the foregoing assembly is finished, the cap (14) as shown in FIG. (10) is inserted into the U shaped passage (9) with the two ears (18) securely received in the two cutouts (15) and the ribs (17) on two opposed sides of the cap (14) respectively received in the two opposed slits (15) of the U shaped passage (9). Thus the cap (14) is able to prevent the umbrella shank from disengagement with the two rubber cushions (13) and the light assembly of the present invention is securely retained on the umbrella shank.

With reference to FIGS. 6, 7, 8 and 9, it is to be noted that the circular base (2), the circular rim (1), components on top of the circular base (2) are the same as those in the first embodiment. Therefore, same reference numerals will be used when referring to the same components in this embodiment. The difference between this embodiment and the previous embodiment is the clamping mechanism (6*b*).

The clamping mechanism (6*b*) is now composed of a U shaped spring (66) received in the U shaped passage (9) with two ends of the U shaped spring (66) respectively received in the two cutouts (16) in two opposed sides of the U shaped passage (9). To allow smooth extension of the umbrella shank into the U shaped passage (9), the U shaped spring has an opening in communication with the U shaped passage (9). The two rubber cushions (13) are then respectively mounted on two sides of the U shaped spring (66) such that when the umbrella shank is extended into the U shaped passage (9), the two rubber cushions (13) are able to clamp the umbrella shank securely. From the foregoing description, it is noted that when illumination is required by the umbrella user, all the user needs to do is to remove the cap (14) from the U shaped passage (9) to expose the opening of the U shaped passage (9). Then the user is able to extend the umbrella shank into the U shaped passage (9) to allow the two rubber cushions (13) to securely clamp the umbrella shank. Thereafter, the user moves the cap (14) back to close the opening of the U shaped passage (9) to prevent the umbrella shank from disengagement with the light assembly of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light assembly comprising:

a circular base having a circuit board mounted thereon, a battery on top of the circular base, a power switch on a side face of the circular base and electrically connected to the battery and the circuit board, a power socket electrically connected to the battery to provide electricity to the battery, light emitting diodes mounted on the circuit board and electrically connected to a controlling chip so that the controlling chip is able to control illumination of the light emitting diodes, a battery seat on top of the circular base to securely receive therein the battery and a U shaped passage defined through a side face of the circular base, wherein the U shaped passage communicates with ambient air;

a circular rim mounted on a peripheral edge of the circular base;

a transparent cover provided to securely engage with the circular rim to enclose the light emitting diodes; and a clamping mechanism securely mounted on two opposed sides of the U shaped passage and having two rubber cushions oppositely movable relative to each other so that when an umbrella shank is extended into the U shaped passage and located between the two rubber cushions, the umbrella shank is securely sandwiched and the light emitting diodes are able to provide illumination.

2. The light assembly as claimed in claim 1, wherein the clamping mechanism further comprises a sliding block movable to the circular base, an engagement block received in the sliding block and having a finger extending out of the sliding block and a pivoting block securely engaged with the sliding block and having an elongated slot defined in a side face thereof to receive therein the finger and the rubber cushion securely attached to a side face thereof oppositely relative to that of the elongated slot such that the movement of each of the sliding blocks on opposite sides of the U shaped passage drives a corresponding one of the two pivoting blocks to move and the rubber cushions are moved to securely clamp the umbrella shank.

3. The light assembly as claimed in claim 2, wherein the sliding block is composed of two halves each having a circular column extending upward, a baffle formed on a side face of each half and an indent defined in a free side of the baffle such that the finger of the engagement block is able to extend out of a hole of the sliding block after the two halves of the sliding block are combined.

4. The light assembly as claimed in claim 2, wherein the pivoting block has a passage defined in the side face where the elongated slot is defined, the sliding block is composed of two halves each having a circular column extending upward, a baffle formed on a side face of each half and an indent defined in a free side of the baffle such that the finger of the engagement block is able to extend out of a hole of the sliding block after the two halves of the sliding block are combined and the circular column of each of the two halves of the sliding block is able to extend into the passage to secure engagement between the pivoting block and the sliding block.

5. The light assembly as claimed in claim 2, wherein the circular base has a spring seat and a spring received in the spring seat, one end of the spring is abutted a side face of the spring seat and the other end of the spring is engaged with a side of the engagement block so that movement of the pivoting block drives the engagement block as well as the spring to move.

6. The light assembly as claimed in claim 3, wherein the circular base has a spring seat and a spring received in the spring seat, one end of the spring is abutted a side face of the spring seat and the other end of the spring is engaged with a side of the engagement block so that movement of the pivoting block drives the engagement block as well as the spring to move.

7. The light assembly as claimed in claim 4, wherein the circular base has a spring seat and a spring received in the spring seat, one end of the spring is abutted a side face of the spring seat and the other end of the spring is engaged with a side of the engagement block so that movement of the pivoting block drives the engagement block as well as the spring to move.

8. The light assembly as claimed in claim 1 further comprising a cap detachably connected to the circular base to close the U shaped passage so as to prevent the umbrella shank from disengagement with the two rubber cushions.

9. The light assembly as claimed in claim 5 further comprising a cap detachably connected to the circular base to close the U shaped passage so as to prevent the umbrella shank from disengagement with the two rubber cushions.

10. The light assembly as claimed in claim 6 further comprising a cap detachably connected to the circular base to close the U shaped passage so as to prevent the umbrella shank from disengagement with the two rubber cushions.

11. The light assembly as claimed in claim 7 further comprising a cap detachably connected to the circular base to close the U shaped passage so as to prevent the umbrella shank from disengagement with the two rubber cushions, wherein the cap has two ribs formed on two opposed sides thereof and two ears extending from two end sides thereof, the U shaped passage has slits defined in two opposite sides thereof to receive therein the ribs of the cap and two cutouts to receive therein the two ears.

12. The light assembly as claimed in claim 1, wherein the clamping mechanism further has a U shaped spring with two ends respectively received in two cutouts defined in two opposed sides of the U shaped passage and the two rubber cushions are securely and oppositely engaged with the U shaped spring such that when an umbrella shank is extended into the U shaped passage and located between the two rubber cushions, the umbrella shank is securely sandwiched and the light emitting diodes are able to provide illumination.

13. The light assembly as claimed in claim 12 further comprising a cap detachably connected to the circular base to close the U shaped passage so as to prevent the umbrella shank from disengagement with the two rubber cushions.

14. The light assembly as claimed in claim 13, wherein the cap has two ribs formed on two opposed sides thereof and two ears extending from two end sides thereof, the U shaped passage has slits defined in two opposite sides thereof to receive therein the ribs of the cap and two cutouts to receive therein the two ears.

* * * * *